United States Patent [19]

O'Rourke et al.

[11] 4,073,229

[45] Feb. 14, 1978

[54] VERTICAL WASTE COMPACTING APPARATUS

[75] Inventors: James O'Rourke, Waldwick, N.J.; Murray Feldberg, Brooklyn, N.Y.

[73] Assignee: Multi-Pak Corporation, Hackensack, N.J.

[21] Appl. No.: 751,704

[22] Filed: Dec. 17, 1976

[51] Int. Cl.[2] ..... B30B 9/00; B30B 15/08

[52] U.S. Cl. ..... 100/98 R; 100/215; 100/229 A; 141/316

[58] Field of Search ..... 100/229 A, 98 R, 215; 220/65; 141/316, 390

[56] References Cited

U.S. PATENT DOCUMENTS

| | | | |
|---|---|---|---|
| 3,405,744 | 10/1968 | Bowman | 100/229 A |
| 3,563,168 | 2/1971 | Doninger | 100/229 A |
| 3,722,561 | 3/1973 | O'Leary | 100/229 A |
| 3,785,278 | 1/1974 | Hopkins | 100/229 A |
| 3,807,299 | 4/1974 | Engebretsen | 100/229 A |
| 3,882,771 | 5/1975 | Frohbieter | 100/229 A |

*Primary Examiner*—Billy J. Wilhite

*Attorney, Agent, or Firm*—Cooper, Dunham, Clark, Griffin & Moran

[57] ABSTRACT

A waste compacting apparatus includes a compactor housing with a vertically reciprocating ram mounted in its upper portion. A waste inlet is provided in the middle portion of the compactor housing for receiving waste, and the received waste is fed into a removable waste receptacle located in the lower portion of the compacting housing. Waste compaction takes place when the vertically reciprocating ram is driven down into the receptacle in the lower portion of the housing. The waste receptacle is horizontally slidable from a first position within the compactor housing, in which compacting takes place, to a second position outside the housing, during which the receptacle is unloaded. A vertically reciprocating sleeve is mounted within the housing, surrounding the ram, and has a waste inlet aperture in its upper portion. The sleeve extends downward from an upper position, in which the housing waste inlet is blocked by the sleeve, to a lower position, in which the waste inlet of the housing and the waste inlet aperture of the sleeve are aligned to permit waste to enter the sleeve and the lower portion of the sleeve extends into the lower portion of the housing within the removable waste receptacle. In this manner the sleeve protects the receptacle as the ram is extended downward to compact the waste within the receptacle. Both the ram and sleeve may be provided with slidably contacting shearing knives, so that any waste trapped between the ram and sleeve will be sheared off and will not jam the compaction apparatus.

5 Claims, 7 Drawing Figures

VERTICAL WASTE COMPACTING APPARATUS

BACKGROUND OF THE INVENTION

This invention relates to waste compactors, and relates more particularly to waste compactors of the type having a vertically reciprocating ram for compacting waste within a removable waste receptacle.

Representative prior art waste compactors of the type having a vertically reciprocating ram and a removable waste receptacle are shown in U.S. Pat. Nos. 3,827,348, 3,831,513 and 3,859,908. Waste compactors having some form of removable sleeve or liner within the receptacle are shown in U.S. Pat. Nos. 3,722,561, 3,807,299, and 3,890,890. In each of the latter three references, however, the liners are rudimentary, manually-inserted devices. These manually-inserted liners typically consist of a number of separable sidewall portions which enable the liners to be manually unfastened so that they can be easily removed from the waste receptacle, and handles are provided to facilitate the various manual operations required.

The manual steps connected with inserting, removing, opening and closing the prior art liners has been found to be both inconvenient and time consuming. Furthermore, since these liners must be light in weight to permit easy manipulation by hand, maximum usable ram compacting pressure may be limited by liner strength. Liner strength and reliability in the prior art structures is further limited by the necessity for a multipiece liner construction, as the various pins, rivets, catches and the like used to removably join the liner sections are a potential source of malfunction.

SUMMARY OF THE INVENTION

An object of the invention is to provide a waste compactor having a liner or sleeve which is of simple and reliable one-piece construction and able to withstand substantial compacting pressure.

It is a further object of the invention to provide a waste compactor in which the sleeve is automatically inserted into and removed from the waste receptacle within the compactor.

Still another object is to provide a waste compactor having shearing means to prevent the compacting ram from being jammed by waste trapped between the ram and the sleeve assembly.

To these and other ends, the present invention contemplates a waste compacting apparatus in which a vertically reciprocating ram mechanism is fitted in the upper portion of the compactor housing. Waste is fed into the compactor housing though a waste inlet opening in the middle portion of the compactor housing. A vertically reciprocating sleeve is mounted within the housing surrounding the ram, and is provided with a waste inlet aperture in its upper portion. When the sleeve is in its upper position, the compactor housing waste inlet opening is blocked by the sleeve, but when the sleeve is extended downward to its lower position, the waste inlet of the housing and the waste inlet aperture of the sleeve are aligned to permit waste to enter the sleeve and fall into the waste receptacle located in the lower portion of the housing. When the sleeve is in its lower position, the lower portion of the sleeve extends into the removable waste receptacle, which may be a plastic waste bag or the like, to prevent the ram or waste materials from damaging the bag or other receptacle.

In order to prevent waste from becoming trapped between the ram and the sleeve as the ram is extended downward within the lowered sleeve, both the ram and sleeve may be provided with slidably contacting shearing knives. Any waste caught between the ram and sleeve will be sheared off, and jamming will be substantially avoided.

The waste receptacle may include a flexible, disposable waste receiving bag, such as a plastic trash bag, and a frame assembly for supporting the bag. The frame is horizontally slidable from a first position within the compactor housing, in which compacting takes place inside the lowered sleeve, to a second position outside the housing, during which the waste receptacle is unloaded after the sleeve has returned to its upper position.

Conventional driving mechanisms for both the ram and the sleeve are included within the compactor housing, and a conventional control mechanism is provided for automatically sequencing the ram and sleeve driving mechanisms.

In this manner the disadvantages associated with the manually inserted liners of the prior art are substantially overcome. The inconvenient and time-consuming manual steps associated with inserting, removing, opening and closing the multi-piece prior art liners are eliminated by providing a convenient, one-piece reciprocating sleeve mechanism, which works automatically within the compactor housing.

Furthermore, by providing an automatically driven, internal, one-piece sleeve, the strength and weight limitations associated with prior art liner devices are overcome. Substantially greater sleeve strength can easily be achieved since light weight is no longer an important consideration, and reliability is improved since it is no longer necessary to have the sleeve constructed in separate, removable sections.

DETAILED DESCRIPTION

Figure 1:
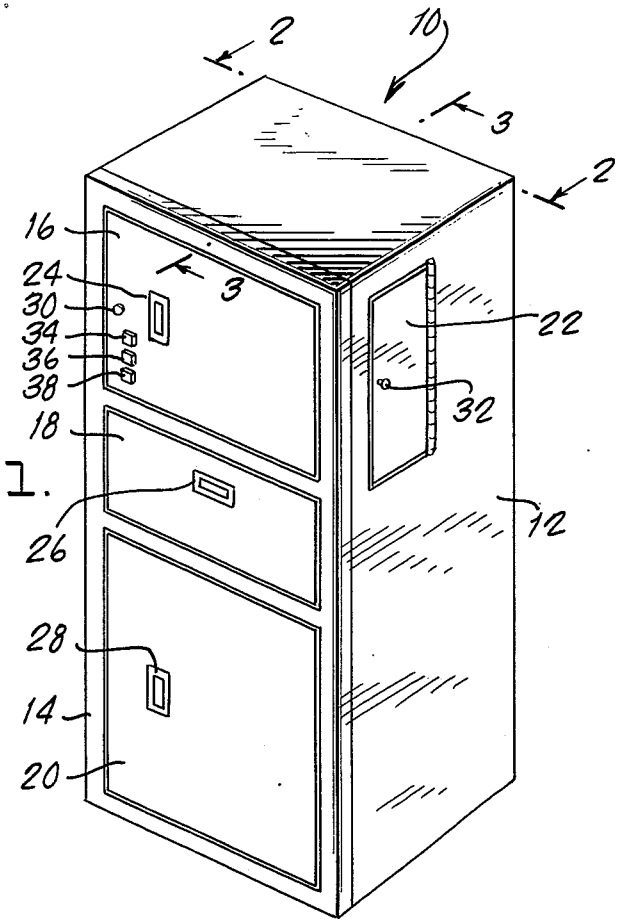
FIG. 1 is a perspective view of a waste compacting apparatus in accordance with the invention.

Referring to FIG. 1 of the drawings, there is shown a waste compacting apparatus, generally identified by the reference numeral 10. The compacting mechanism is contained within a compactor housing 12. Access to the interior of the housing is obtained through doors 16, 18 and 20, located respectively in the upper, middle and lower portion of front panel 14. A fourth access door 22 is provided in the front upper side portion of housing 12.

Front panel doors 16, 18 and 20 are respectively provided with handles 14, 16 and 18, and doors 16 and 22 are provided with key locks 30 and 32 to prevent unauthorized access. Indicator lights 34, 36 and 38 are located on upper front panel 16, and serve as a visual indication of operating status, as will be explained in greater detail hereinafter.

Figure 2:
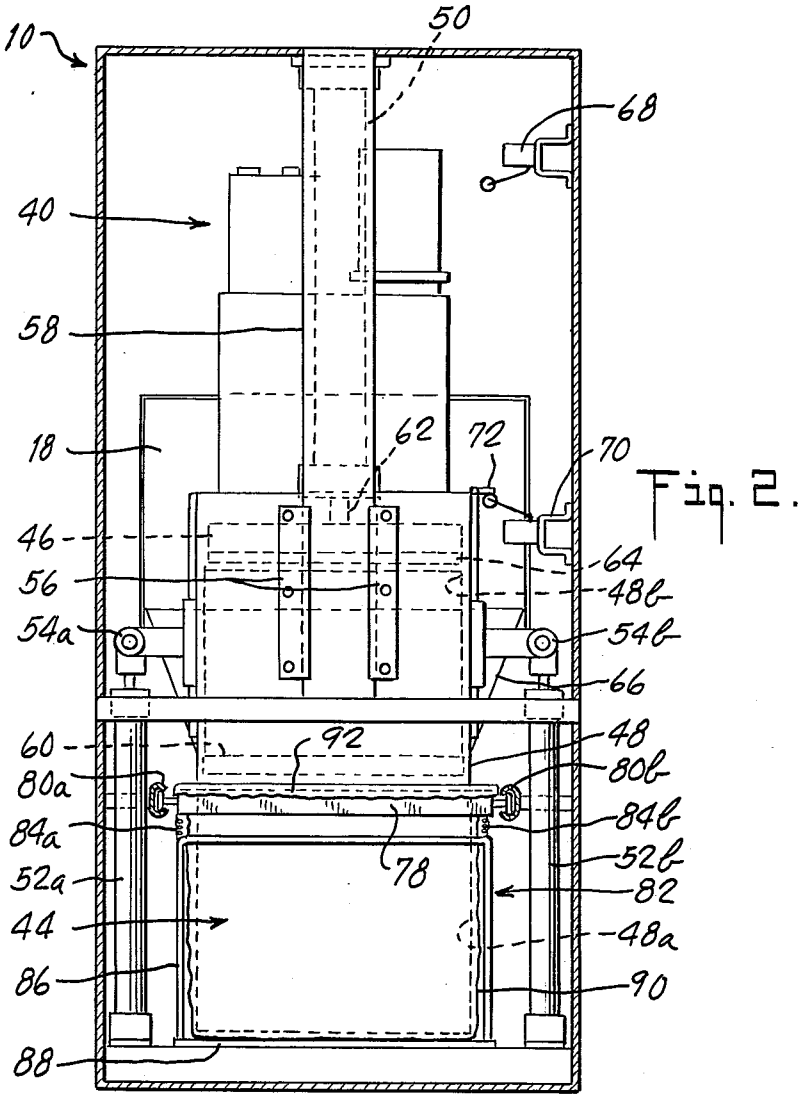
FIG. 2 is a rear, sectional view of the waste compacting apparatus along the lines 2—2 of FIG. 1; and FIGS. *3a–3e* are simplified side sectional views along the lines 3—3 of FIG. 1 showing a typical operating cycle of the waste compacting apparatus.

The internal construction of the compacting apparatus is shown in FIGS. 2 and *3a–3e*. Behind upper door 16 of front panel 14 is located the hydraulic generating and controlling mechanism, generally identified by the reference numeral 40 in FIGS. 2 and 3*a*. Since the hydraulic unit is of conventional design, it is not described in detail. The electrical control circuits, also of conventional design, are mounted in the upper side portion of the compactor housing behind door 22.

Figure 3C:
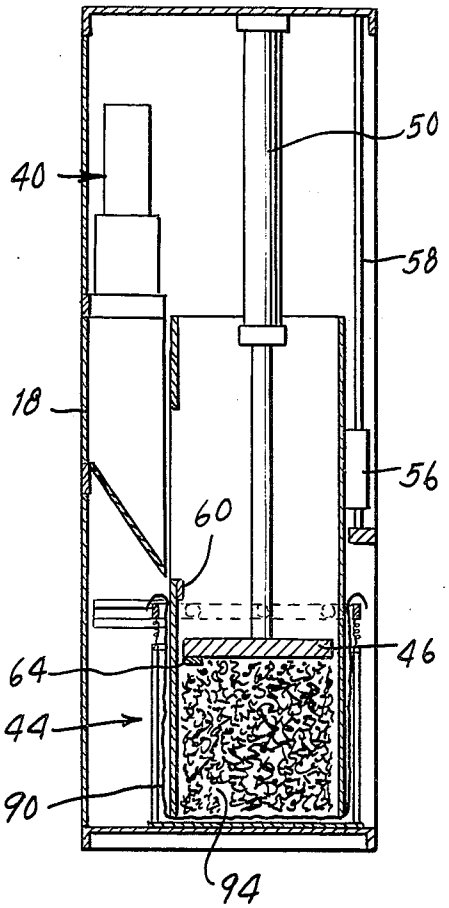
Figure 3B:
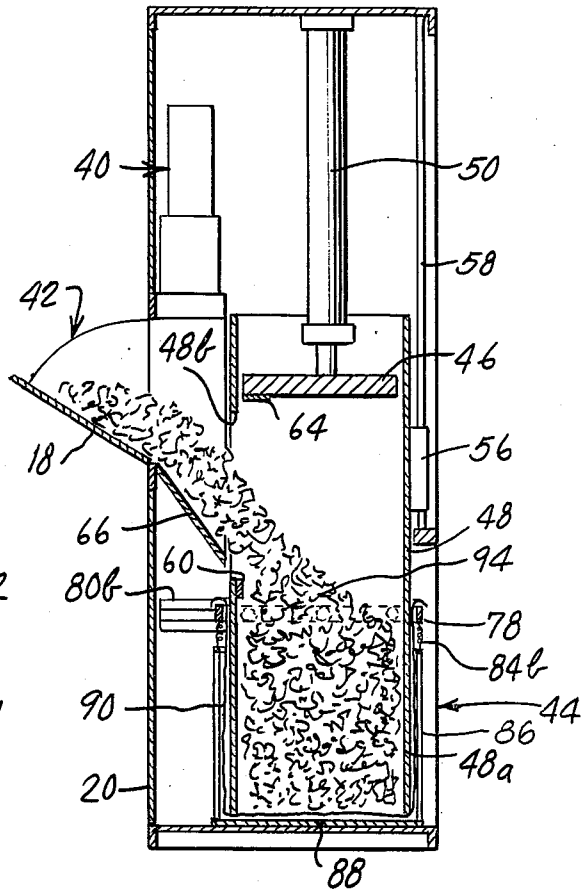
Figure 3A:
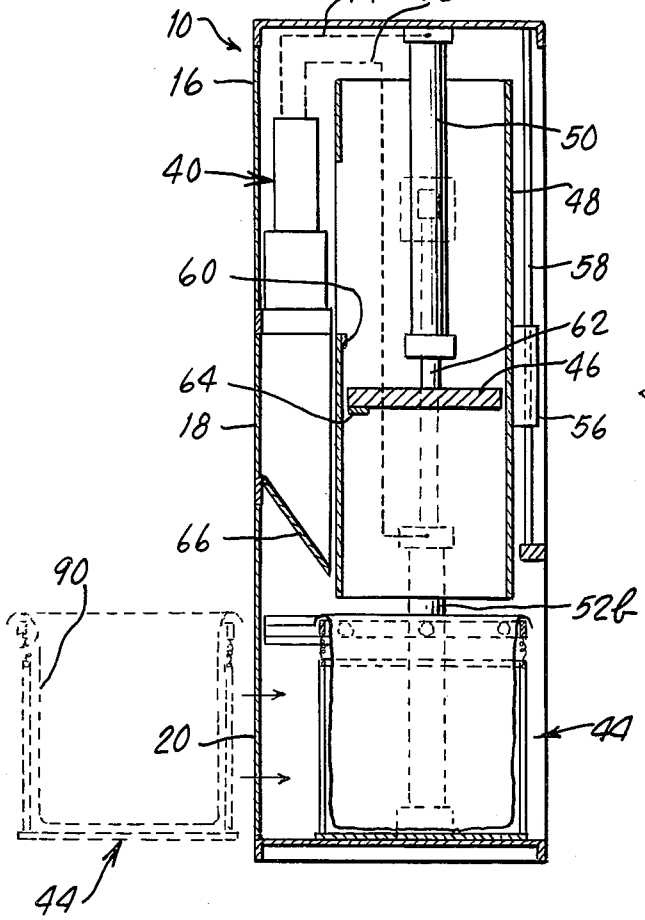
Figure 3C:
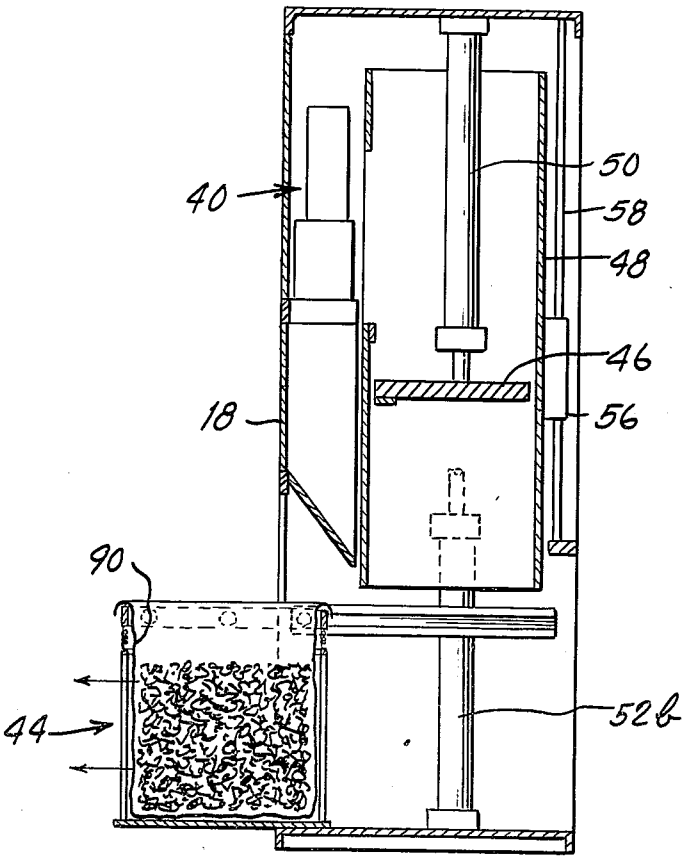

Waste inlet door 18, located in the middle portion of front panel 14, pivots outwardly around its lower horizontal edge, so that its inner surface serves as the upper portion of a waste inlet chute 42, as shown in FIGS. 3*a* and 3*b*.

Behind door 20, located in the lower portion of front panel 14, there is located a removable waste receptacle generally identified by the reference numeral 44. This waste receptacle serves to receive waste deposited within compactor housing 12 through inlet chute 42.

Within the compactor housing are two cooperating, vertically reciprocating components, a compaction ram 46 and a sleeve 48. Ram 46 is driven by hydraulic cylinder 50, and sleeve 48 is driven by hydraulic cylinders 51*a* and 52*b*, as shown in FIG. 2.

In the simplified rear view of FIG. 2, ram 46 is shown in its upper position, while sleeve 48 is shown in its lower position, in which its lower section 48*a* extends within the waste receptacle 44. Both ram 46 and surrounding sleeve 48 are of rectangular horizontal cross section, and waste inlet aperture 48*b* of sleeve 48 is seen directly below and in front of ram 46 when the latter is in its upper position. Vertically reciprocating sleeve 48 is driven by hydraulic cylinders 52*a* and 52*b*, mounted on either side of the compactor housing 12, through conventional coupling brackets 54*a* and 54*b*, respectively. The sleeve is slidably supported by sleeve slide 56, which slides along sleeve slide track 58 of the compactor housing, as shown in FIGS. 2 and 3*a*. Also shown in FIGS. 2 and 3*a* is a fixed shearing knife 60, which is horizontally mounted on the inner front surface of the sleeve immediately below aperture 48*b*.

Vertically reciprocating ram 46 is driven by hydraulic cylinder 50 through shaft 62. The upper end of hydraulic cylinder 50 is mounted to the upper horizontal surface of compactor housing 12, and the hydraulic cylinder drives the ram betwee a first position just above waste inlet aperture 48*b*, as shown in FIG. 2, and a lower position within receptacle 44 is shown in FIG. 3*c*. An adjustable shearing knife 64 is bolted to the forward edge of ram 46, parallel to fixed shearing knife 60, and knife 64 is adjusted to permit the two shearing knives to slide across each other as the ram is driven down within the sleeve.

With reference to FIG. 3*b*, waste received from waste inlet chute 42 slides into the compactor housing along the inclined inner surface of door 18, and is directed toward waste inlet aperture 48*b* of sleeve 48 by angled plate 66, which is mounted on the compactor housing immediately below door 18. Also mounted on the compactor housing are limit switches 68 and 70 which, in combination with switch actuator 72 mounted on the reciprocating sleeve and associated control circuitry, serve to control the uppermost and lowermost limits of travel of the sleeve 48. As shown in FIG. 2, as the sleeve 48 approaches its lowermost position, actuator 72 contacts lower limit switch 70, which cuts off sleeve driving power from hydraulic cylinders 52*a* and 52*b* to stop the sleeve. Similarly, as sleeve 48 approaches its uppermost position, actuator 72 contacts upper limit switch 68, thus causing driving power from hydraulic cylinders 52*a* and 52*b* to be again cut off. The various electrical and hydraulic interconnections between the hydraulic generating and controlling mechanism 40, the hydraulic cylinders 50, 52*a* and 52*b*, and the limit switches 68 and 70 are of a conventional nature and accordingly are omitted in the interest of clarity, although representative control lines to hydraulic cylinders 50 and 51*b* are schematically shown by dotted lines 74 and 76 in FIG. 3*a*.

As shown in the embodiment of FIGS. 2 and 3*a*–3*e*, removable waste receptacle 44 includes an upper frame member 78 which is slidably mounted to compactor housing 12 by a pair of sliding track mounting assemblies 80*a* and 80*b*. A lower frame 82 is removably attached to upper frame 78 by four springs, one at each of the four corners of the rectangular frame members. Rear springs 84*a* and 84*b* are shown in FIG. 2, and a similar pair of springs is employed to suspend the front corners of the lower frame. Lower frame 82 includes an open upper framework 86 and a solid horizontal lower plate 88. A flexible, disposable waste receiving bag 90, of plastic or other suitable material, is disposed within the waste receptacle with its upper edge 92 extending over and around the upper framework 78.

When sleeve 48 is in its lowermost position, with its lower portion 48*a* extending within waste bag 90, received waste does not come in contact with the sidewalls of the waste bag during loading or compaction, as shown in FIGS. 3*b* and 3*c*. In this manner, tearing of the relatively fragile waste bag 90 is in direct contact with the received waste, this portion of the bag is directly supported by lower plate 88 of framework 86, and furthermore, the bottom surface of the bag is not subject to the tearing forces which act on its vertical side surfaces due to the vertical movement of waste 94 during loading and compaction.

With reference to the simplified side sectional views of FIGS. 3*a*–3*e*, there is shown a typical operating cycle of the waste compacting apparatus 10. At the start of the operating sequence, as shown in FIG. 3*a*, both ram 46 and sleeve 48 are in their upper positions, so that access to waste receptacle 44 through door 18 is blocked by the front surface of sleeve 48. Prior to the start of the waste compaction cycle, lower door 20 is opened and waste receptacle 44 is pulled out to its external position, as shown in dotted lines in 3*a*. While the waste receptacle is in its external position, the flexible waste receiving bag 90 is inserted within the receptacle as shown, the receptacle is slid to its internal position in vertical alignment with the sleeve and ram, as shown in solid lines in FIG. 3*a*, and lower door 20 is closed. The compacting apparatus is now ready to begin loading.

The loading portion of the cyle is shown in FIG. 3*b*. Ram 46 remains in its upper position, while sleeve 48 has been extended downwardly so that its lower portion 48*a* is within the waste receptacle and waste inlet aperture 48*b* is aligned with waste inlet chute 42 and angled plate 66 to provide a clear path from the waste inlet chute to the waste receptacle. Door 18 is opened, and waste is deposited through inlet chute 42 and slides down the inner surface of door 18. The deposited waste continues along angled plate 66 and falls though waste inlet aperture 48*b* of sleeve 48 and down into waste bag 90 in the waste receptacle.

Figure 3D:
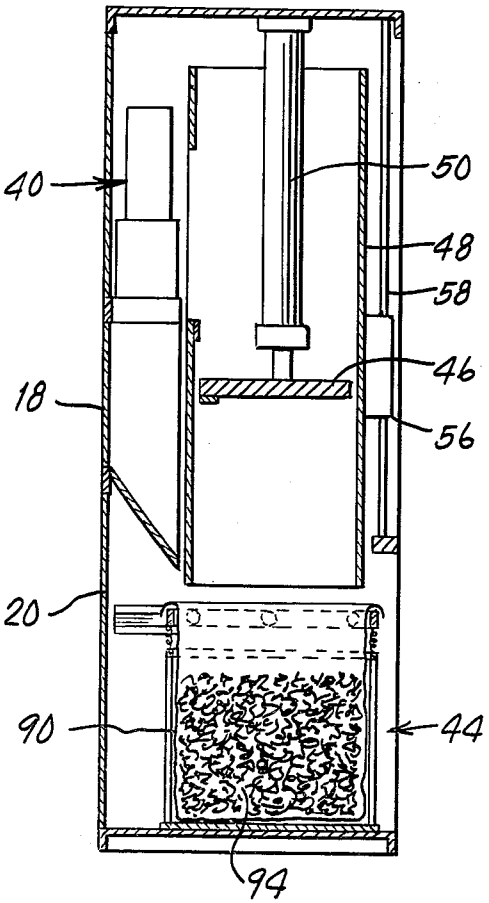

When bag 90 has been filled with loose waste, door 18 is closed and ram 46 is driven downward within lowered sleeve 48 to compact the loose waste. As the ram travels down, ram shearing knife 64 slides across sleeve shearing knife 60, so that any waste material not fully within the compacting chamber formed by the interior of sleeve 48 will be sheared off. The loading and compaction cycles of FIGS. 3*b* and 3*c* are alternately repeated until the bag 90 is completely filled with compacted waste. At this point, the ram 46 and then the sleeve 48 is driven to its upper position, as shown in FIG. 3*d*. The waste receptacle 44, containing the filled waste bag 90, is now free to be slid to its external position for unloading. Lower door 20 is then opened and waste receptacle 44 is slid to its exterior position, as shown in FIG. 3*e*, and filled waste bag 90 is removed. A new waste receiving bag may then be inserted in the waste receptacle 44 and a new cycle started.

In this manner, the complete waste compacting cycle, including the insertion and removal of the protective sleeve, is performed automatically within the waste compacting housing, with no need for the awkward and time-consuming manual steps required with prior art liners. The possibility of the compacting ram becoming jammed is greatly reduced by the shearing action of knives 60 and 64. Since the relatively light, multi-piece liner typically used in prior art devices has been replaced by a solid, one-piece sleeve, increased compacting pressures may be employed without sacrificing reliability or durability.

To ensure operator safety, the waste compacting apparatus may be provided with various safety interlocks of a conventional nature, as will be apparent to one skilled in the art. Indicator lights 34, 36 and 38 are provided on upper front panel 16 to give a visual indication of operating status. Light 34 indicates that power is being supplied to the compacting apparatus, while light 36 indicates that the compactor ram is in operation and light 38 indicates that the waste receiving bag is full and requires changing.

While the invention has been particularly shown and described with reference to a preferred embodiment thereof, it will be understood by those skilled in the art that various changes in form and detail may be made without departing from the spirit and the scope of the invention.

What is claimed is:

1. A compacting apparatus for receiving and compacting waste, which comprises:

a compactor housing having an upper portion, a middle portion and a lower portion;

vertically reciprocating ram means for compacting waste, mounted in the upper portion of said housing, said ram means being of rectangular cross section and being extendable downwardly into the lower portion of said housing:

ram driving means for driving said vertically reciprocating ram means;

waste inlet means in the front middle portion of said compactor housing for receiving waste to be compacted;

removable waste receptacle means for containing waste, said receptacle means being horizontally slidable between a first position in the lower portion of said compactor housing in vertical alignment with said ram means and a second position without the lower portion of said compactor housing, said ram means extending downwardly within the receptacle means while said receptacle means is in the first position to effect waste compaction;

vertically reciprocating sleeve means of rectangular cross-section slidably mounted within said housing surrounding said ram means and having an upper portion and a lower portion, said sleeve means having a rectangular waste inlet aperture in its front upper portion and said sleeve means being extendable downwardly from an upper position, in which access from said compactor housing waste inlet means to said waste receptacle means is blocked by said sleeve, to a lower position in which said sleeve waste inlet aperture is aligned with said compactor housing waste inlet means and the lower portion of said sleeve means extends within said removable waste receptacle means to prevent said ram means from damaging said receptacle means as said ram means is extended downwardly within said receptacle means;

sleeve driving means for driving said vertically reciprocating sleeve means;

control means for controlling the operation of said ram driving means and said sleeve driving means; and a first shearing knife horizontally mounted on the inner front surface of said sleeve means adjacent to the lower edge of said rectangular waste inlet aperture, and a second shearing knife horizontally mounted on the front edge of said ram means adjacent and parallel to the apertured surface of said sleeve means, said second shearing knife slidably contacting said first shearing knife as said ram means is extended downwardly past said inlet aperture into the lower portion of said housing.

2. A compacting apparatus as in claim 1, wherein said first shearing knife is fixedly mounted to said sleeve means and said second shearing knife is adjustably mounted to said ram means.

3. A compacting apparatus as in claim 1, wherein said removable waste receptacle means further comprises a flexible, disposable waste receiving bag and a horizontally slidable frame assembly for removably supporting said waste receiving bag.

4. A compacting apparatus as in claim 1, wherein said compactor housing waste inlet means comprises a waste receiving hopper having an inlet portion and an outlet portion, and a pivotably mounted waste chute adjacent to said hopper inlet portion, said waste chute being pivotable between a first position in which said chute substantially covers said inlet portion and a second position in which said chute uncovers said inlet portion and delivers received waste thereto.

5. A compacting apparatus as in claim 1, wherein said ram driving means comprises a hydraulic driving cylinder mounted in the upper portion of said compactor housing, said sleeve driving means comprises a pair of hydraulic driving cylinders, one mounted on each side of said compactor housing in the lower portion thereof, and wherein a sleeve slide track is mounted on the rear of said compactor housing for slidably receiving said vertically reciprocating sleeve means.

* * * * *

UNITED STATES PATENT AND TRADEMARK OFFICE

CERTIFICATE OF CORRECTION

PATENT NO. : 4,073,229

DATED : February 14, 1978

INVENTOR(S) : James O'Rourke and Murray Feldberg

It is certified that error appears in the above-identified patent and that said Letters Patent are hereby corrected as shown below:

Col. 1, line 53, "though" should read -- through --

Col. 2, line 59, "14, 16 and 18" should read -- 24, 26 and 28 --

Col. 3, line 20, "51a" should read -- 52a --

Col. 3, line 42, "betwee" should read -- between --

Col. 4, line 6, "51b" should read -- 52b --

Col. 4, line 28, after "waste bag" there should be inserted -- sidewalls is avoided. Although the bottom of waste bag --

Signed and Sealed this

*Twenty-second* Day of *August 1978*

[SEAL]

*Attest:*

RUTH C. MASON
*Attesting Officer*

DONALD W. BANNER
*Commissioner of Patents and Trademarks*